United States Patent [19]

Borgoyn et al.

[11] 4,220,195

[45] Sep. 2, 1980

[54] ION DRAG PUMPED HEAT PIPE

[75] Inventors: Milton J. Borgoyn, Glen Burnie; Archer S. Mitchell, Silver Spring, both of Md.

[73] Assignee: The United States of America as represented by the Secretary of the Navy, Washington, D.C.

[21] Appl. No.: 42,165

[22] Filed: May 24, 1979

[51] Int. Cl.[3] ..... F28D 15/00

[52] U.S. Cl. ..... 165/1; 165/105; 417/49

[58] Field of Search ..... 165/1, 105; 417/49

[56] References Cited

U.S. PATENT DOCUMENTS

| | | | |
|---|---|---|---|
| 3,169,693 | 2/1965 | Herzog | 417/49 |
| 3,682,239 | 8/1972 | Abu-Romia | 165/105 X |

OTHER PUBLICATIONS

Hwang, U. P. *Magnetic Wickless Heat Pipe,* IBM Technical Disclosure Bulletin, vol. 13, No. 11, 4/1971.

Jones, T. B. *Electrohydronamic Heat Pipes,* Int. J. Mass Transfer, vol. 16, No. 5, pp. 1045–1048, 5/1973.

*Primary Examiner*—Albert W. Davis

*Attorney, Agent, or Firm*—Richard S. Sciascia; Thomas M. Phillips

[57] ABSTRACT

Conventional heat pipe performance can be improved by reducing the dependency upon the capillary pumping limitation. Electrodes mounted either in the working fluid vapor or its condensate produce an ion flow directed axially and in the same flow direction. The ion flow, through collision phenomena, picks-up the surrounding low velocity stream, increases its momentum and generates additional pumping pressure for the condensate. Performance can be improved even when low surface tension working fluids are used.

13 Claims, 9 Drawing Figures

$N_l$ - LIQUID TRANSPORT FACTOR
H - WICKING HEIGHT FACTOR
$(Q/A)_s$ - SONIC LIGHT FLUX LIMIT
$\nu_v/\nu_l$ - KINEMATIC VISCOSITY RATIO $N_l$ - LIQUID TRANSPORT FACTOR
H - WICKING HEIGHT FACTOR
$(Q/A)_s$ - SONIC LIGHT FLUX LIMIT
$\nu_v/\nu_l$ - KINEMATIC VISCOSITY RATIO

ION DRAG PUMPED HEAT PIPE

BACKGROUND OF THE INVENTION

The invention relates to heat pipes and, in particular, to means for improving their liquid transport capability.

Conventional heat pipes are in the form of an elongate, sealed tubular housings having an evaporator section at one end, a condenser section at the other and an intermediate adiabatic section. Internally, the tube is lined with a wicking structure providing capillary passages filled or saturated with a particular working fluid at a given temperature and saturation pressure. Operationally, thermal inputs to which the evaporator section may be exposed vaporize the working fluid resulting in a vapor pressure gradient. The gradient produces a vapor flow through the adiabatic section to the condenser where the vapor condenses onto the wicking giving-up its latent heat of vaporization. The phase change occuring at very nearly a constant temperature provides a highly efficient transport of thermal energy.

Continuity of the thermal transport requires a return flow of the liquid condensate to the evaporator by the wicking. Usually, this flow relies upon capillary pumping which, largely, is a function of surface tension, liquid-vapor contact angle, pore size and other related factors. However, as will be recognized, the pumping capability of any particular structure is limited and the limitation affects design and performance. If, for example, the pipe uses a working fluid having a low surface tension characteristic, its performance or thermal power is correspondingly low. In this regard, thermal power can be considered as amount of heat capable of being delivered per unit temperature difference between its end portion of the pipe. It involves not only the hydrodynamic and hydrostatic losses in the system but also the rate of the delivery. Increases in the pumping force can improve the performance and power output as well as reduce reliance upon surface tension characteristics, pore size, etc. However, prior art arrangements seem to rely primarily upon capillary pumping and consequently do not provide optimum performance particularly when certain desirable working fluids are used.

Surface tension, as already noted, plays a heavy role in capillary pumping. Unfortunately, however, many otherwise desirable working fluids have a relatively low surface tension. In particular, dielectric working fluids have surface tensions about an order of magnitude below that of water. Otherwise, these dielectrics are most attractive due to their relatively low working temperatures. In many heat pipe operations, the temperature range in which the pipes will operate is a critical parameter. For example, when used in aircraft, space or other similar situations, the temperature range may be so low that many fluids, such as water, may freeze. Dielectrics, such as Freon II, are indicated but, again, their low surface tension is undesirable. Consequently, prior art heat pipes which for the most part rely solely upon capillary pumping are faced at best with a tradeoff and, in some situations, may use certain working fluids even though there is a considerable sacrifice in efficiency or thermal power.

It is therefore an object to provide a heat pipe arrangement permitting a wide selection of working fluids such as a number of the low surface tension dielectrics.

A further object is to increase or eliminate the capillary pumping limit of prior art heat pipes.

Another object is to achieve these results in a simple, economic and highly efficient manner.

As will be described, a primary feature of the invention is the use of ion drag forces to pump the liquid condensate from the condenser to the evaporator.

BRIEF DESCRIPTION OF THE DRAWINGS

The invention is illustrated in the accompanying drawings of which.

DETAILED DESCRIPTION OF THE INVENTION

As will be described, the present invention provides two different arrangements both of which employ ion drag forces to transport the liquid condensate of a heat pipe from its condenser to its evaporator sections. In the arrangement shown in FIGS. 2 and 3 the liquid condensate is pumped by a liquid ion drag pump mounted directly in the liquid condensate. In the other embodiment of FIGS. 4 and 5, the liquid condensate is pumped by an ion drag pressure generated by a corona wind produced in the working fluid vapor being transported from the evaporator to the condenser. Both embodiments result in either the raising or the elimination of the capillary pumping limit. Improvements in thermal power consequently are achievable as is the use of dielectric liquids of poor surface tension.

Referring to FIGS. 2–5 it first should be recognized that, except for certain ion drag features to be described, the intent simply is to illustrate a conventional heat pipe structure and arrangement. Obviously, other arrangements incorporating a variety of prior art teachings or other modifications are contemplated providing, of course, their use is consistent with the present ion drag principles.

Figure 2:
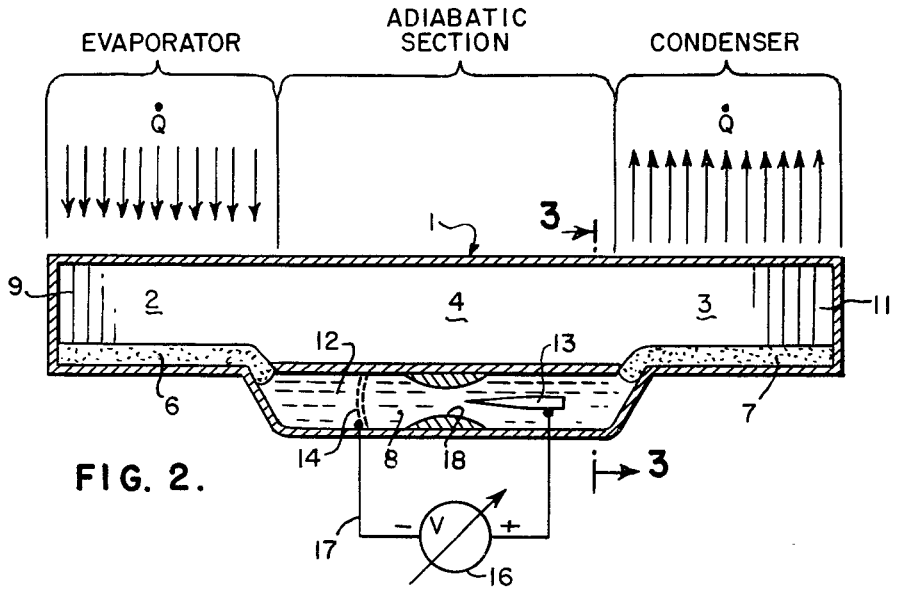
FIGS. 2 and 3 are schematics showing an embodiment utilizing a liquid ion drag pump.
Figure 3:
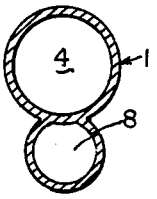

The heat pipe of FIGS. 2 and 3 is in the form of a sealed, tubular housing 1 having a conventional evaporator section 2, a condenser section 3 and an intermediate adiabatic section 4. Internally, the evaporator and condenser sections both are lined with wick sections 6 and 7 between which there is an open pumping section or chamber 8 devoid of any wicking. Wicks 6 and 7 may be of any conventional structure characterized by the provision of capillary pores or other capillary passages through which the working fluid is transported in its liquid form. As presently used, the wicks are stainless steel structures of 120 mesh. However, as known in the prior art, parallel capillary channels or tubes can be used in lieu of actual mesh-type wicking. In the present invention, the terms 'wick' or 'wicking' are intended to include such capillary tubes. Also, since the present invention at least minimizes the characteristic capillary pumping capacity of the wick structures, use of wicking except perhaps for the purpose of distributing the fluid in the evaporator and condenser ends is not a critical concern. Working fluid distribution at both ends of the pipe also is improved by the use of distribution grooves 9 and 11.

For operational purposes, wicks 6 and 7 as well as chamber 8 are filled with a working fluid 12 at a given temperature and saturation pressure. The intended operation itself is conventional at least to the extent that thermal energy received at one end is transported to and released at the other. As indicated by the arrows of FIG. 2, heat applied to evaporator 2 vaporizes fluid 12 and the vapor travels or flows under a vapor pressure gradient through adiabatic section 4 to condenser 3 where it is given-up externally. Release of the latent heat of vaporization condenses the vapor into a liquid that settles into wick section 7 for return to evaporator 2 for recycling.

In a conventional heat pipe the liquid return transport of the condensate is achieved by the capillary pumping action and, as already noted, their performance consequently may be limited. The limit is reached when the hydrodynamic and hydrostatic losses in the heat pipe exceed the capillary pumping capability. More specifically, this capillary pumping limit is the liquid transport factor $N_1$ as defined in "Heat Pipe Design Handbook", E. A. Skrabek and W. B. Bienert, NASA Contract NAS9-11927, August 1972. As there shown:

$$N_1 = \frac{\rho_1 \sigma \lambda}{\mu_1} \qquad \text{EQ. (1)}$$

where:

$^{92}1$=liquid density $\sigma$=surface tension $\lambda$=heat of vaporization $\mu 1$=viscosity Surface tension clearly is a determinative factor. Further, it plays a significant role in determining the maximum capillary pumping pressures for any individual heat pipe. This value ($P_{cap}$) is defined as follows (supra):

$$\Delta P_{cap} = \frac{2\,\sigma \cos\theta}{R_p} \qquad \text{EQ. (2)}$$

where:

$\Theta$=angle of vapor-liquid $R_p$=radius of wick pore.

For the case of $H_2O$ at 100° C. assuming $\Theta=0°$ (scrupulously clean) and a stainless steel 120 mesh yields:

$\Delta P_{cap}=0.9$ in $H_2O$

Obviously, in the design of heat pipes that are dependent wholly upon capillary pumping, the properties of the working fluid are a prime concern and one that too often requires design compromises.

The principle feature of the present invention is the use of an ion drag force to augment or in some cases eliminate this maximum capillary pumping limit. In the embodiment shown in FIGS. 2 and 3, the ion drag force is provided by a liquid ion drag pump arrangement. Thus, as shown in FIG. 2, the ion drag pump is provided by mounting a pair of electrodes 13 and 14 directly in the liquid condensate present in pumping section 8 of the pipe. A voltage supply 16 coupled to the electrodes by a circuit 17 provides electrical energization. Stressed electrode 13 may be a pointed probe or a small diameter wire while electrode 14 which is a collector is a porous screen or a cylindrical electrode. Ion drag pump arrangements such as the one shown in FIG. 2 are, however, conventional devices which have been used in other circumstances to create a drag force capable of pumping or moving a liquid. In general, the stressed electrode produces high energy ion flow moving from the stressed electrode as a source to the collector. This high energy flow, through collision phenomena, in effect picks up the momentum of the surrounding relatively low velocity fluid stream. In the present case, its force is applied to the liquid condensate to pump it back to the evaporator. This pumping force at least supplements the maximum capillary pumping capability. In practice, it has been shown that such liquid ion drag pumps can provide pressures on the order of, conservatively, 15 inches of $H_2O$.

Figure 9:
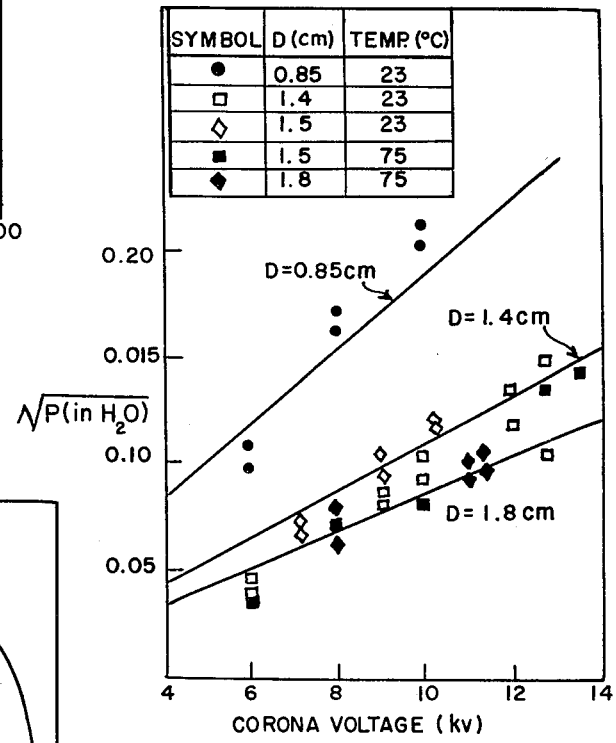
FIG. 9 is a plot showing corona voltage versus corona wind pressure characteristics derived in an experimental study in which the corona was created in air.

To achieve the desired results, the ion flow should be directed axially of the liquid condensate within pumping chamber 8 and, of course, the electrodes are mounted to produce this result. Also, for proper operation, the working fluid should be a polarizable liquid such as water, Freon, methane, nitrogen or many others. Effectiveness can be increased by the use of a convex, ring flange 18 mounted or formed near the small diameter point of stressed electrode 13 to funnel the flow into the high energy ion flow. The spacing of electrodes 13 and 14 as well as the applied voltages are matters that will vary with each individual design. In general, they are indicated in the plot of FIG. 9.

Figure 4:
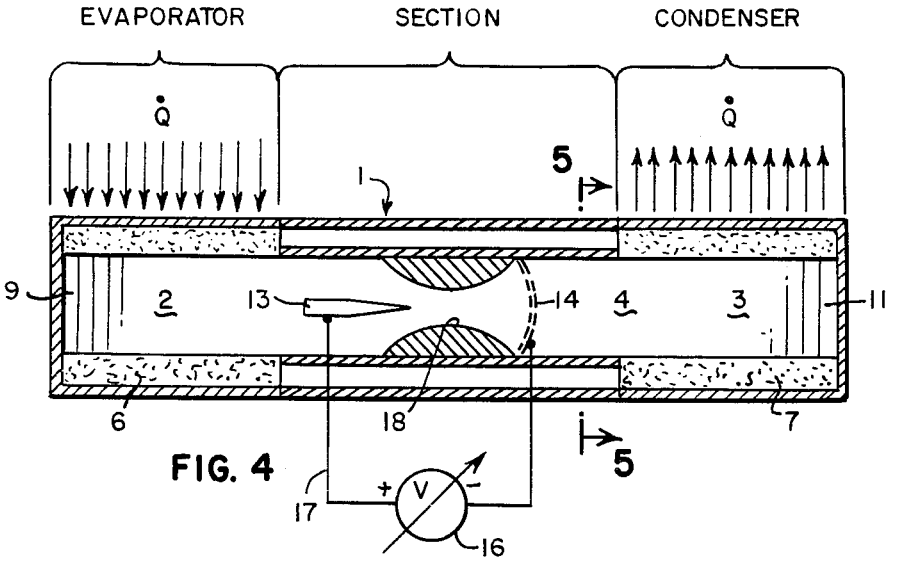
FIGS. 4 and 5 are views similar to FIGS. 2 and 3 showing another embodiment utilizing a corona wind pressure pump for producing an ion drag liquid transport force.
Figure 5:
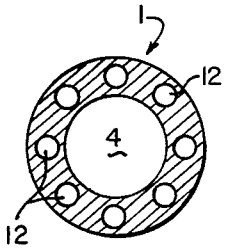

The embodiment of FIGS. 4 and 5 is quite similar to that of FIG. 2 in that it also uses the pair of electrodes 13 and 14 in a heat pipe formed to operate much in the same manner as the one already described. For this reason, the various component parts of this embodiment have been identified by the same numerals. The two principal differences are that, first, the electrode arrangement is mounted in the vapor flow of the pipe where, again, its ion flow is directed axially of the vapor flow and in the same direction. The return flow of the liquid condensate is from condenser wicking 7 through a plurality of small, flow tubes 12 which are comparable to chamber 12 of FIG. 2. However, the use of the flow tubes is optional. If desired, the wicking can be continuous from one end to the other.

Figure 1:
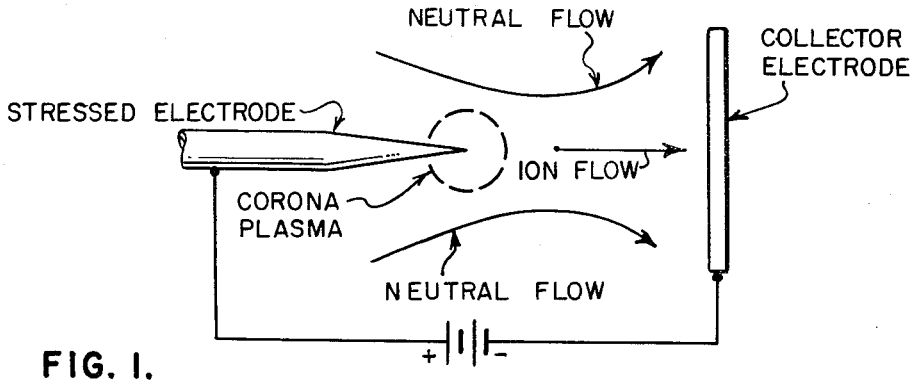
FIG. 1 schematically depicts the basic principles applicable to the creation of a so-called 'corona wind' used in one embodiment to provide the desired ion drag force for liquid transport purposes.

Functionally considered, the FIG. 4 arrangement also is an ion drag pump that generates a so-called 'corona wind' to create the desired liquid transport. However, this corona or electric wind phenomenon is well known and, for example is explained in a publication by A. S. Mitchell and L. E. Williams "Investigation of Heat Transfer by Corona Wind from a Horizontal Surface"; Final Report on Contract N00019-76-C-0454, Naval Air Systems Command, available through the Defense Documentation Center (DDC). In brief, a corona wind effect is analogoues to the functioning of a jet pump. Thus, an analogy can be made between the pick-up of momentum of a low velocity fluid stream in the case of a jet pump with the pick-up of momentum of the low velocity neutral gas by the high energy flow of ions from a corona discharge. FIG. 1 is provided as a simple illustrative depiction. The analogy, of course, is for descriptive purposes since the real similarity involves only the collision phenomena which results in the momentum transfer. This is the same type of collision phenomena ocurring in the FIG. 2 arrangement. In the FIG. 4 embodiment, the electric wind is the secondary flow of the neutral gas in the presence of the corona. The use of a polarizable liquid is not important to the FIG. 4 device since there is no need to ionize the liquid molecules.

The so-called electric wind pressure is applied to the liquid in wick 7, flow tubes 12 and wick 6 to at least increase the maximum capillary pumping capacity. Tests of its effect show that pressures of 0.2 inches of $H_2O$ can be generated although it is expected that greater pressures can be obtained in carefully designed heat pipes. Although the 0.2 inches is considerably below the comparable 15 inches of the FIG. 2 pump, it will be appreciated that the lower pressure is moving vapor rather than the relatively high density liquid. FIG. 9 shows corona voltage versus corona wind pressure characteristics where the corona was created in air. The plot further indicates appropriate electrode spacing (D) and electrode voltages.

Another important aspect of the invention which evolves from the increase in liquid transport pressure is the fact that it enables the use of many working fluids which otherwise might be ruled out because of their poor physical properties such as their low surface tension. As has been shown, surface tension plays a paramount role in capillary pumping. Consequently, to the extent that the need for capillary pumping is reduced, the role of surface tension also is reduced.

Figure 6:
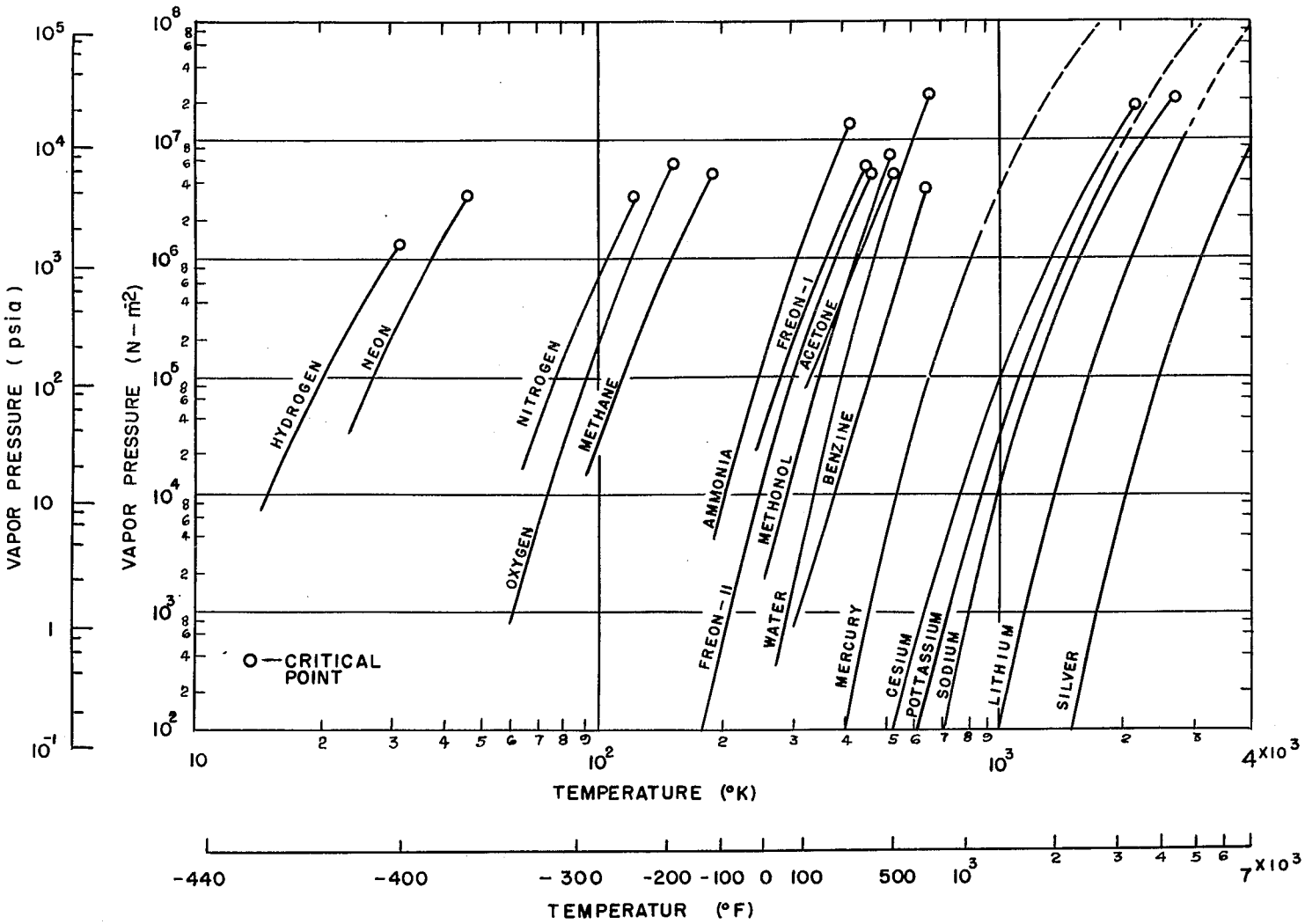
FIG. 6 is a plot providing a comparison of the vapor pressures of a number of heat pipe working fluids.
Figure 7:
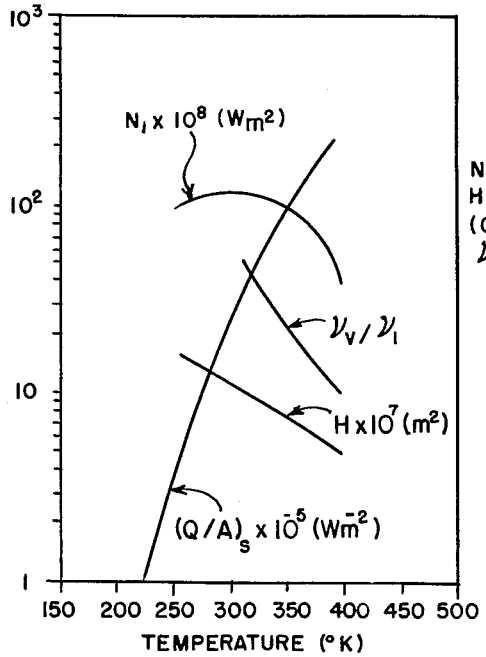
FIGS. 7 and 8 are plots showing the heat pipe liquid transport factors for Freon II and $H_2O$ respectively.
Figure 8:
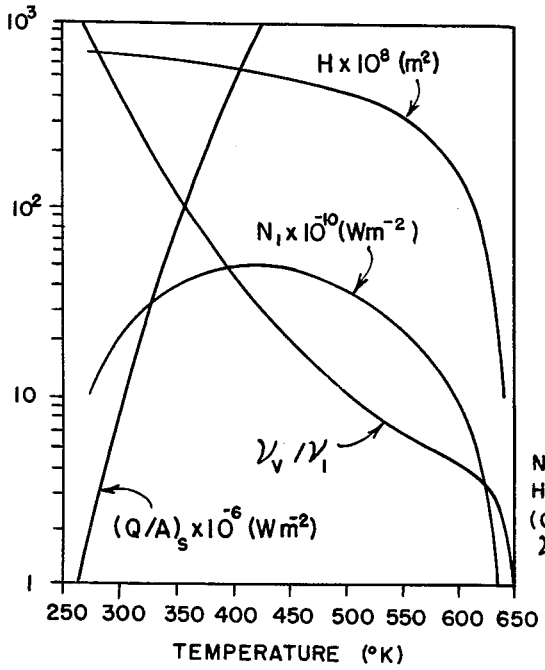

Many otherwise attractive working fluids show poor performance because they have relatively low surface tension. In particular, many dielectric fluids have a surface tension property about an order of magnitude below that of water. Included in this group are the freons. Otherwise, freon and other dielectric fluid heat pipes are or may be quite attractive principally because their working temperature is below that of water. FIG. 6, for example, compares the working temperatures of a number of possible working fluids including Freon II and water. In actual heat pipe design, the primary consideration usually is the anticipated working temperature range. If it is sufficiently low, a fluid having a working temperature appropriate for the range must be used. This requirement, for example, may dictate the use of Freon II or the like but, if so, the heat pipe will have a relatively low capillary pumping limit and a relatively low thermal power output. By the use of the ion drag pumping arrangements of FIGS. 2 or 4 the need for considering the surface tension factor is minimized and reliance upon capillary pumping, at least, is reduced. Thus, the ion drag feature permits the use of a wide variety of working fluids which otherwise might be ruled out. FIGS. 7 and 8 are provided to show the relative liquid transport factors for water and Freon II. For example, at 300° K. the transport factor for water is about 16 times better than that of Freon II.

In summary, heat pipes using the principles that have been described provide a number of significant advantages. In particular, they permit higher higher heat fluxes, lower operating temperatures, lower operating pressures, and a control of the heat pipe by varying the pumping pressure. Also, by using the ion drag pressure, heat pipes employing a number of dielectric fluids become competitive particularly for low temperature applications. A further advantage is that the increased pressure permits the liquid condensate to be moved vertically or in opposition to gravity so that the pipes are not gravity dependent. If used in a horizontal attitude they are capable of moving more of the working fluid.

Obviously many modifications and variations of the present invention are possible in the light of the above teachings. It is therefore to be understood that within the scope of the appended claims the invention may be practiced otherwise than as specifically described.

We claim:

1. A method of increasing the capillary pumping capability of a capillary structure contained in a heat pipe for the purpose of transporting a working fluid in a liquid condensate form from a condenser section to an evaporator section in which said liquid is vaporized and cycled as a gas back through said pipe to said condenser section, comprising:

creating an ion flow axially within and in the same flow direction as said working fluid for increasing the momentum of said fluid, and applying said increased momentum to said liquid condensate for increasing said pumping capability.

2. The method of claim 1 wherein said ion flow is created directly in said liquid condensate.

3. The method of claim 2 wherein said liquid condensate is a polarizable dielectric fluid having a surface tension and a working temperature both less than that of water.

4. The method of claim 1 wherein said ion flow is created directly in said gas.

5. The method of claim 4 wherein said working fluid in its liquid form is a dielectric fluid having a surface tension and a working temperature less than that of water.

6. Heat pipe apparatus comprising:

an elongate housing having longitudinally spaced evaporator and condenser sections, a working fluid contained in the housing, the fluid being vaporizable for delivery as a gas to said condenser section and condensible therein for return delivery as a liquid back to the evaporator section, means for returning said liquid condensate, said means having a capillary pumping limit determined in part by the surface tension characteristics of the condensate, and means for increasing said capillary pumping limit, said means including:

a pair of longitudinally-spaced electrodes mounted in said heat pipe between said evaporator and condenser sections, and circuit means for electrically energizing said electrodes sufficiently to produce an ion flow therebetween in the delivery direction of said working fluid, said ion flow functioning as an ion drag pump to increase the momentum of said working fluid and exert additional pressure on said liquid condensate sufficient to raise said capillary pumping limit.

7. The apparatus of claim 6 wherein:

said means for returning said liquid condensate includes capillary wicking structures disposed in each end of the housing and an elongate pumping chamber disposed intermediate of said wicking structures, said pumping chamber and wicking structure capillaries being filled with said liquid condensate, and said pair of longitudinally-spaced electrodes is mounted directly in said liquid condensate of said intermediate pumping chamber.

8. The apparatus of claim 7 wherein said pair of electrodes includes:

a stressed electrode in the form of a probe having a small diameter end portion, and a collector electrode, said stressed electrode being a source for said ion flow and being mounted axially of said elongate intermediate chamber.

9. The apparatus of claim 7 wherein said liquid condensate is a polarizable dielectric having a surface tension and a working temperature both less than that of water.

10. The apparatus of claim 9 wherein said liquid condensate is Freon II.

11. The apparatus of claim 6 wherein said pair of longitudinally-spaced electrodes is mounted directly in said vaporized gas axially of its flow path.

12. The apparatus of claim 11 wherein said working fluid is a dielectric having a surface tension and a working temperature both less than that of water.

13. The apparatus of claim 12 wherein said working fluid is Freon II.

* * * * *